US007196685B2

(12) United States Patent
Lee et al.

(10) Patent No.: US 7,196,685 B2
(45) Date of Patent: Mar. 27, 2007

(54) DATA DRIVING APPARATUS AND METHOD FOR LIQUID CRYSTAL DISPLAY

(75) Inventors: Seok Woo Lee, Kyoungsangbuk-do (KR); Su Kyung Choi, Kyoungsangbuk-do (KR)

(73) Assignee: LG.Philips LCD Co., Ltd, Seoul (KR)

( * ) Notice: Subject to any disclaimer, the term of this patent is extended or adjusted under 35 U.S.C. 154(b) by 465 days.

(21) Appl. No.: 10/125,523

(22) Filed: Apr. 19, 2002

(65) Prior Publication Data

US 2003/0071779 A1 Apr. 17, 2003

(30) Foreign Application Priority Data

Oct. 13, 2001 (KR) ..... 10-2001-63208

(51) Int. Cl.
*G09G 3/36* (2006.01)

(52) U.S. Cl. ..... 345/99; 345/98; 345/100

(58) Field of Classification Search ..... 345/87–100
See application file for complete search history.

(56) References Cited

U.S. PATENT DOCUMENTS

| | | | | |
|---|---|---|---|---|
| 5,170,158 | A | 12/1992 | Shinya | |
| 5,510,748 | A | 4/1996 | Erhart et al. | |
| 6,078,318 | A | 6/2000 | Mori et al. | |
| 6,097,362 | A | 8/2000 | Kim | |
| 6,256,005 | B1 | 7/2001 | Kim | 345/88 |
| 6,268,841 | B1 * | 7/2001 | Cairns et al. | 345/98 |
| 6,335,721 | B1 | 1/2002 | Jeong | |
| 2001/0017607 | A1 * | 8/2001 | Kwon et al. | 345/87 |
| 2001/0020988 | A1 | 9/2001 | Ohgiichi et al. | |

FOREIGN PATENT DOCUMENTS

| | | |
|---|---|---|
| DE | 198 21 914 | 11/1998 |
| DE | 198 54 730 | 9/1999 |
| EP | 0 368 572 | 5/1990 |
| EP | 0 929 064 | 7/1999 |
| EP | 1058232 A2 | 12/2000 |
| EP | 1 191 513 A2 | 3/2002 |
| JP | 2001-175214 | 6/2001 |
| WO | WO 98/28731 | 7/1998 |

* cited by examiner

*Primary Examiner*—Alexander Eisen
(74) *Attorney, Agent, or Firm*—Morgan, Lewis & Bockius, LLP

(57) ABSTRACT

A data driving apparatus for a liquid crystal display includes a digital-to-analog converter part for converting input pixel data into a plurality of pixel signals and time-dividing the converted pixel data signals to time-divided pixel signals, wherein the number of the converted pixel signals is greater than that of the time-divided pixel signals, at least two output buffer parts for sequentially receiving the pixel signals from the digital-to-analog converter part, buffering the time-divided pixel signals, and outputting the buffered time-divided pixel signals to a plurality of data lines, at least two of the plurality of output buffer parts being commonly connected to the digital-to-analog converter part, and a timing controller for controlling the digital-to-analog converter part and the output buffer parts and time-dividing the pixel data supplied to the digital-to-analog converter part into at least two regions to sequentially supply the time-divided pixel data to the data lines.

23 Claims, 6 Drawing Sheets

DATA DRIVING APPARATUS AND METHOD FOR LIQUID CRYSTAL DISPLAY

This application claims the benefit of Korean Patent Application No. P2001-63208, filed in Korea on Oct. 13, 2001, which is hereby incorporated by reference.

BACKGROUND OF THE INVENTION

1. Field of the Invention

The present invention relates to a liquid crystal display, and more particularly, to a data driving apparatus and method for a liquid crystal display wherein a digital to analog converter and an output buffer are separately integrated to dramatically reduce a loss caused by a poor tape carrier package. Also, the present invention is directed to a data driving apparatus and method for a liquid crystal display wherein a digital to analog converter is driven on a time division basis to reduce the number of integrated circuits for providing a digital to analog conversion function.

2. Discussion of the Related Art

Generally, a liquid crystal display (LCD) controls a light transmittance of a liquid crystal using an electric field to display a picture. To this end, the LCD includes a liquid crystal display panel having liquid crystal cells arranged in a matrix, and a driving circuit for driving the liquid crystal display panel.

In the liquid crystal display panel, gate lines and data lines are arranged in such a manner as to cross each other. A liquid crystal cell is positioned at each intersection of the gate lines and the data lines. The liquid crystal display panel is provided with a pixel electrode and a common electrode for applying an electric field to each of the liquid crystal cells. Each pixel electrode is connected, via source and drain electrodes of a thin film transistor as a switching device, to any one of data lines. The gate electrode of the thin film transistor is connected to any one of the gate lines allowing a pixel voltage signal to be applied to the pixel electrodes for each one line.

The driving circuit includes a gate driver for driving the gate lines, a data driver for driving the data lines, and a common voltage generator for driving the common electrode. The gate driver sequentially applies a scanning signal to the gate lines to sequentially drive the liquid crystal cells on the liquid crystal display panel one line at a time. The data driver applies a data voltage signal to each of the data lines whenever the gate signal is applied to any one of the gate lines. The common voltage generator applies a common voltage signal to the common electrode. Accordingly, the LCD controls a light transmittance by an electric field applied between the pixel electrode and the common electrode in accordance with the data voltage signal for each liquid crystal cell, to thereby display a picture. Each of the data drivers and gate drivers is formed from an integrated circuit (IC) chip. They are mounted in a tape carrier package (TCP) and connected to the liquid crystal display panel by a tape automated bonding (TAB) system mainly.

FIG. 1 schematically shows a data driving block in a conventional LCD.

Referring to FIG. 1, the data driving block includes data driving ICs 4 connected, via TCPs 6, to a liquid crystal display panel 2, and a data printed circuit board (PCB) 8 connected, via the TCPs 6, to the data driving ICs 4.

The data PCB 8 receives various control signals from a timing controller (not shown), and data signals and driving voltage signals from a power generator (not shown) to interface them to the data driving ICs 4. Each of the TCPs 6 is electrically connected to a data pad provided at the upper portion of the liquid crystal display panel 2 and an output pad provided at each data PCB 8. The data driving ICs 4 convert digital pixel data into analog pixel signals to apply them to data lines on the liquid crystal display panel 2.

To this end, as shown in FIG. 2, each of the data driving ICs 4 includes a shift register part 14 for applying a sequential sampling signal. A latch part 16 sequentially latches a pixel data VD in response to the sampling signal and outputs the pixel data VD at the same time. A digital to analog converter (DAC) 18 for converts the pixel data VD from the latch part 16 into a pixel signal. An output buffer part 26 buffers the pixel signal from the DAC 18 to output it. Further, the data driving ICs 4 each include a signal controller 10 for interfacing various control signals from a timing controller (not shown) and the pixel data VD. A gamma voltage part 12 supplies positive and negative gamma voltages required in the DAC 18. Each of the data driving ICs 4 drives n data lines DL1 to DLn.

The signal controller 10 controls various control signals such as, for example, SSP, SSC, SOE, REV and POL, and the pixel data VD to output them to the corresponding elements. The gamma voltage part 12 sub-divides several gamma reference voltages from a gamma reference voltage generator (not shown) for each gray level and outputs the sub-divided gamma reference voltges.

Shift registers included in the shift register part 14 sequentially shift a source start pulse SSP from the signal controller 10 in response to source sampling clock signal SSC to output the source start pulse SSP as a sampling signal.

A plurality of n latches included in the latch part 16 sequentially sample the pixel data VD from the signal controller 10 in response to the sampling signal from the shift register part 14 to latch it. Subsequently, the n latches respond to a source output enable signal SOE from the signal controller 10 to output the latched pixel data VD at the same time. In this case, the latch part 16 restores the pixel data VD modulated in such a manner to have a reduced transition bit number in response to a data inversion selecting signal REV and then outputs the pixel data VD. This is because the pixel data VD, having a transition bit number going beyond a reference value, is supplied such that it is modulated to have a reduced transition bit number in order to minimize an electromagnetic interference (EMI) upon data transmission from the timing controller.

The DAC 18 converts the pixel data VD from the latch part 16 into positive and negative pixel signals at the same time and outputs the signals. To this end, the DAC 18 includes a positive (P) decoding part 20 and a negative (N) decoding part 22, each of which are commonly connected to the latch part 16, and a multiplexor (MUX) 24 for selecting output signals of the P and N decoding parts 20 and 22.

A plurality of n P decoders, which are included in the P decoding part 20, convert n pixel data simultaneously inputted from the latch part 16 into positive pixel signals with the aid of positive gamma voltages from the gamma voltage part 12. A plurality of n N decoders, which are included in the N decoding part 22, convert n pixel data simultaneously inputted from the latch part 16 into negative pixel signals with the aid of negative gamma voltages from the gamma voltage part 12. The multiplexor 24 responds to a polarity control signal POL from the signal controller 10 to selectively output the positive pixel signals from the P decoding part 20 or the negative pixel signals from the N decoding part 22.

A plurality of n output buffers included in the output buffer part 26 consist of voltage followers which are connected to the n data lines DL1 to DLn in series. These output buffers buffer the pixel signals from the DAC 18 and apply the signals to the data lines DL1 to DLn.

As described above, each of the conventional data driving ICs 4 should have n latches and 2n decoders so as to drive n data lines DL1 to DLn. As a result, the conventional data driving IC 4 has a disadvantage in that it has a complex configuration and a relatively high manufacturing cost.

Furthermore, each of the conventional data driving ICs 4 is attached to the TCP 6 in a single chip to adhered to the liquid crystal display panel 2 and the data PCB 8 as shown in FIG. 1. Accordingly, the TCP has a high probability of, for example, breaking or short-circuiting. Thus, a large loss in costs results since the data driving ICs 4 mounted in the TCP 6 also cannot be used when the TCP 6 breaks or short-circuits.

SUMMARY OF THE INVENTION

Accordingly, the present invention is directed to a data driving apparatus and method for liquid crystal display that substantially obviates one or more of problems due to limitations and disadvantages of the related art.

Another object of the present invention is to provide a data driving apparatus and method for a liquid crystal display wherein a digital to analog converter and an output buffer are separately integrated to dramatically reduce loss caused by a poor tape carrier package.

Another object of the present invention is to provide a data driving apparatus and method for a liquid crystal display wherein a digital to analog converter is driven on a time division basis to reduce the number of integrated circuits for providing a digital to analog conversion function.

A further object of the present invention is to provide a data driving apparatus and method for a liquid crystal display wherein the number of input pins of an output buffer IC is reduced to sufficiently assure a pitch of an output pad on a printed circuit board.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a data driving apparatus for a liquid crystal display includes a digital to analog converter part for converting input pixel data into a plurality of pixel signals and time-dividing the converted pixel signals to output the time-divided pixel signals, wherein the number of the converted pixel signals is greater than that of the time-divided pixel signals, at least two output buffer parts for sequentially receiving the pixel signals from the digital to analog converter part, holding the time-divided pixel signals, and then buffering and outputting the time-divided pixel signals to a plurality of data lines, at least two of the plurality of output buffer parts being commonly connected to the digital to analog converter part, and timing controller for controlling the digital to analog converter part and the output buffer parts and time-dividing the pixel data supplied to the digital to analog converter part into at least two regions to sequentially supply the time-divided pixel data to the data lines.

In another aspect of the present invention, a method of driving a data driving apparatus for driving a plurality of data lines arranged at a liquid crystal display panel wherein the driving apparatus includes a plurality of output buffer parts connected to each of the plurality of data lines, and a digital to analog converter part commonly connected to input terminals of at least two of the plurality of output buffer parts, the method includes time-dividing pixel data to be supplied to the digital to analog converter part into at least two regions to provide a time-divided pixel data, allowing the digital to analog converter part to convert each pixel data into analog pixel signals and time-dividing the converted pixel, and allowing the at least two output buffer parts to sequentially receive and hold each of the pixel signals and buffer the pixel signals, thereby applying the pixel signals to the plurality of data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 3:
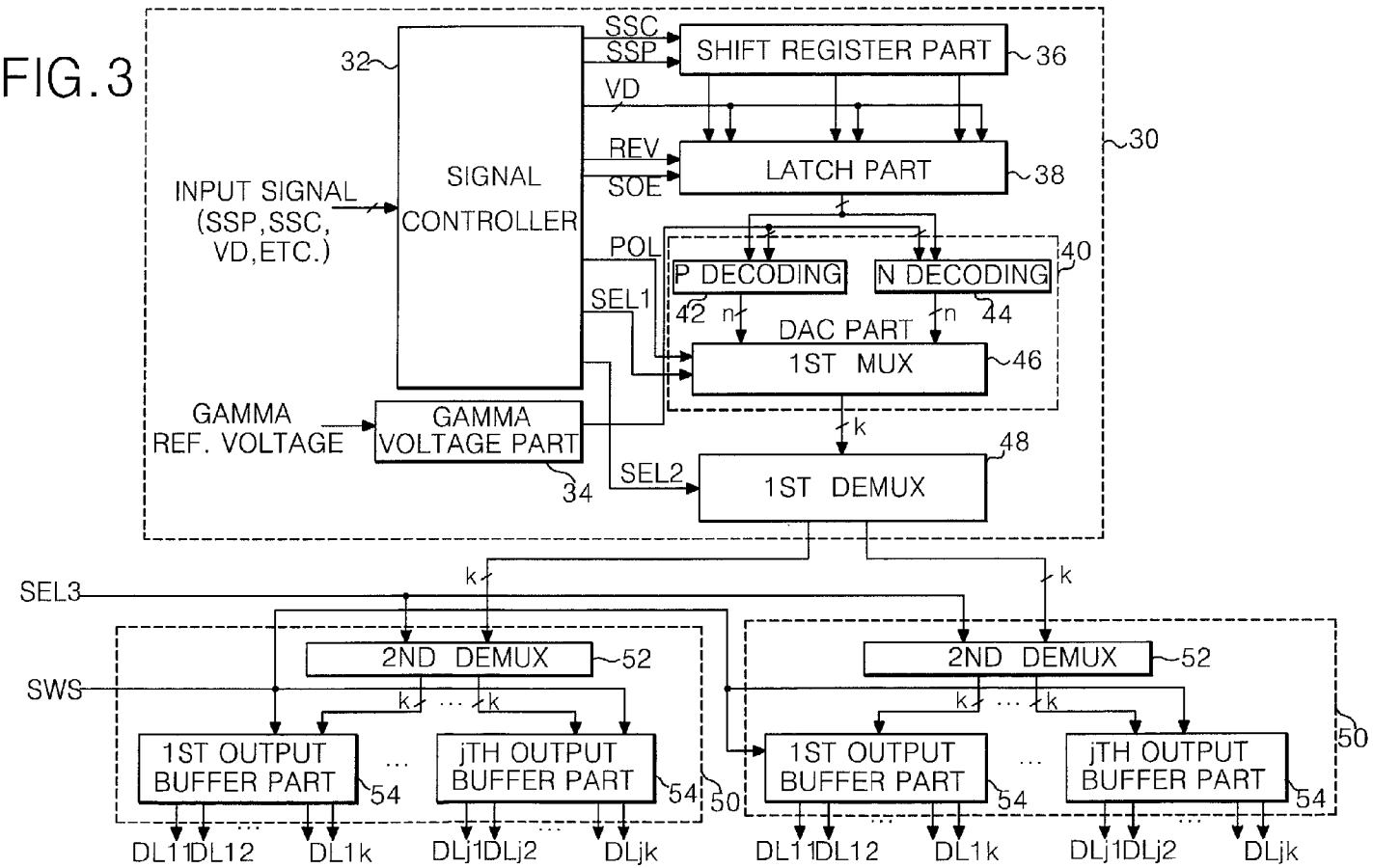
FIG. 3 is a block diagram showing a configuration of a data driver in a liquid crystal display according to an embodiment of the present invention.

FIG. 3 is a block diagram showing a configuration of a data driving apparatus for a liquid crystal display according to an embodiment of the present invention.

Referring to FIG. 3, the data driving apparatus is largely divided into DAC means having a digital to analog conversion function and buffer means having an output buffering function, which are integrated into a separated chip. In other words, the data driving apparatus has a DAC IC 30 and at least two output buffer ICs 50 configured separately. Particularly, the DAC IC 30 is divided into at least two regions on a time basis such that the at least two output buffer ICs 50 are commonly connected to a single DAC IC 30 for driving, to thereby provide a DAC function.

Hereinafter, a case where two output buffer ICs 50 are commonly connected to a single DAC IC 30 will be described as an example.

A plurality of 2n pixel data to be supplied to 2n data lines DL11 to DL1n and DL21 to DL2n are divided on a time basis n by n to be inputted to the DAC IC 30. The DAC IC 30 converts n input pixel data into analog pixel signals. Furthermore, the DAC IC 30 again divides the n pixel signals converted into analog signals k by k (wherein k<n) to selectively apply them to the first and second output buffer ICs 50. Since the DAC IC 30 should divide the 2n pixel data n by n to provide a digital to analog conversion function, required driving signals have frequencies twice those of the conventional driving signals.

To this end, the DAC IC 30 includes a shift register part 36 for applying a sequential sampling signal. A latch part 38 sequentially latches a pixel data VD in response to the sampling signal and outputs the pixel data VD at the same time. A digital to analog converter (DAC) 40 converts the pixel data VD from the latch part 38 into a pixel signal. A first demultiplexor 48 sequentially applies the pixel signal from the DAC 40 to two output buffer ICs 50. Furthermore, the DAC IC 30 includes a signal controller 32 for interfacing various control signals from a timing controller (not shown) and the pixel data VD. A gamma voltage part 34 supplies positive and negative gamma voltages required in the DAC 40.

The signal controller 32 controls various control signals such as, for example, SSP, SSC, SOE, REV and POL,) from a timing controller and the pixel data VD to output them to the corresponding elements. In this case, the timing controller allows the various control signals and POL, etc.) and the pixel data VD to have a frequency twice that of prior art arrangements. Particularly, the timing controller makes a time division of 2n pixel data VD corresponding to the 2n data lines DL11 to DL1n and DL21 to DL2n into two regions to sequentially supply them n by n.

The gamma voltage part 34 sub-divides a plurality of gamma reference voltages from a gamma reference voltage generator (not shown) for each gray level and outputs the sub-divided gamma reference voltages.

Shift registers included in the shift register part 36 sequentially shift a source start pulse SSP from the signal controller 32 in response to a source sampling clock signal SSC to output the source start pulse SSP as a sampling signal. In this case, the shift register part 36 responds to the source start pulse SSP and the source sampling clock signal SSC each having a frequency doubled to output a sampling signal at twice the speed in comparison to prior art arrangements.

A plurality of n latches included in the latch part 38 sequentially sample the pixel data VD from the signal controller 32 in response to the sampling signal from the shift register part 36 to latch it. In this case, the latches sample the pixel data VD at the rising or falling edge of the source sampling clock signal SSC from the signal controller 32. Subsequently, the n latches respond to a source output enable signal SOE from the signal controller 32 to output the latched pixel data VD at the same time. In this case, the latches restore the pixel data VD modulated in such a manner as to have a reduced transition bit number in response to a data inversion selecting signal REV and then output the pixel data VD. This is because the pixel data VD, having a transition bit number going beyond a reference value, is supplied such that it is modulated to have a reduced transition bit number in order to minimize an electromagnetic interference (EMI) upon data transmission from the timing controller.

Figure 1:
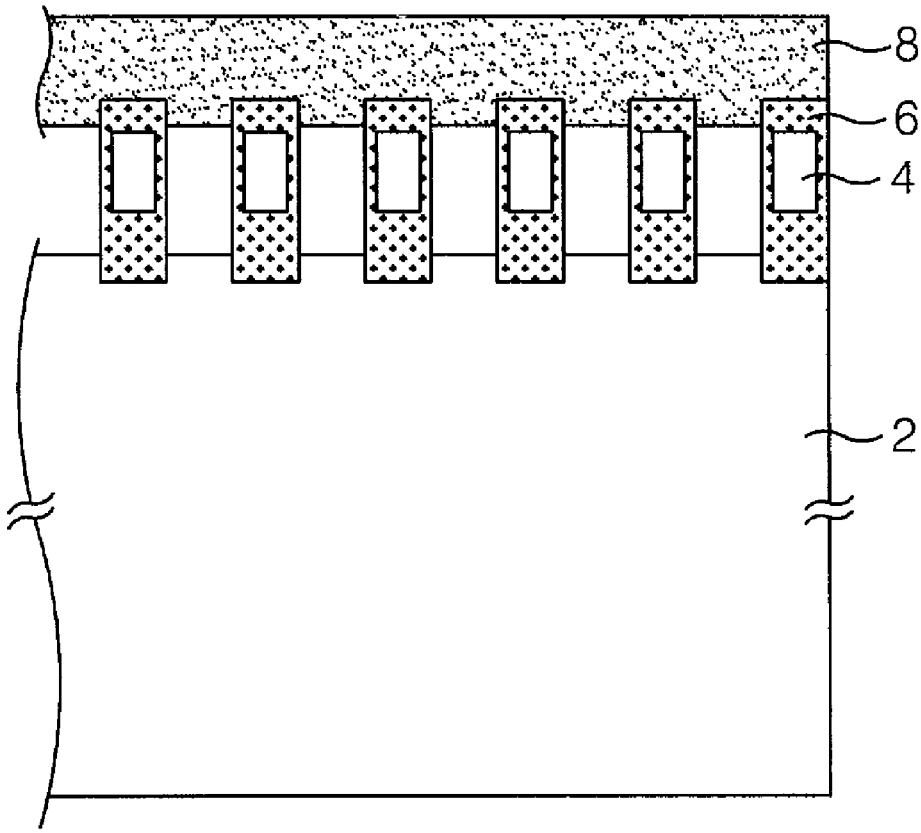
FIG. 1 CONVENTIONAL ART
FIG. 1 is a schematic view showing a data driving block in a conventional liquid crystal display.
Figure 2:
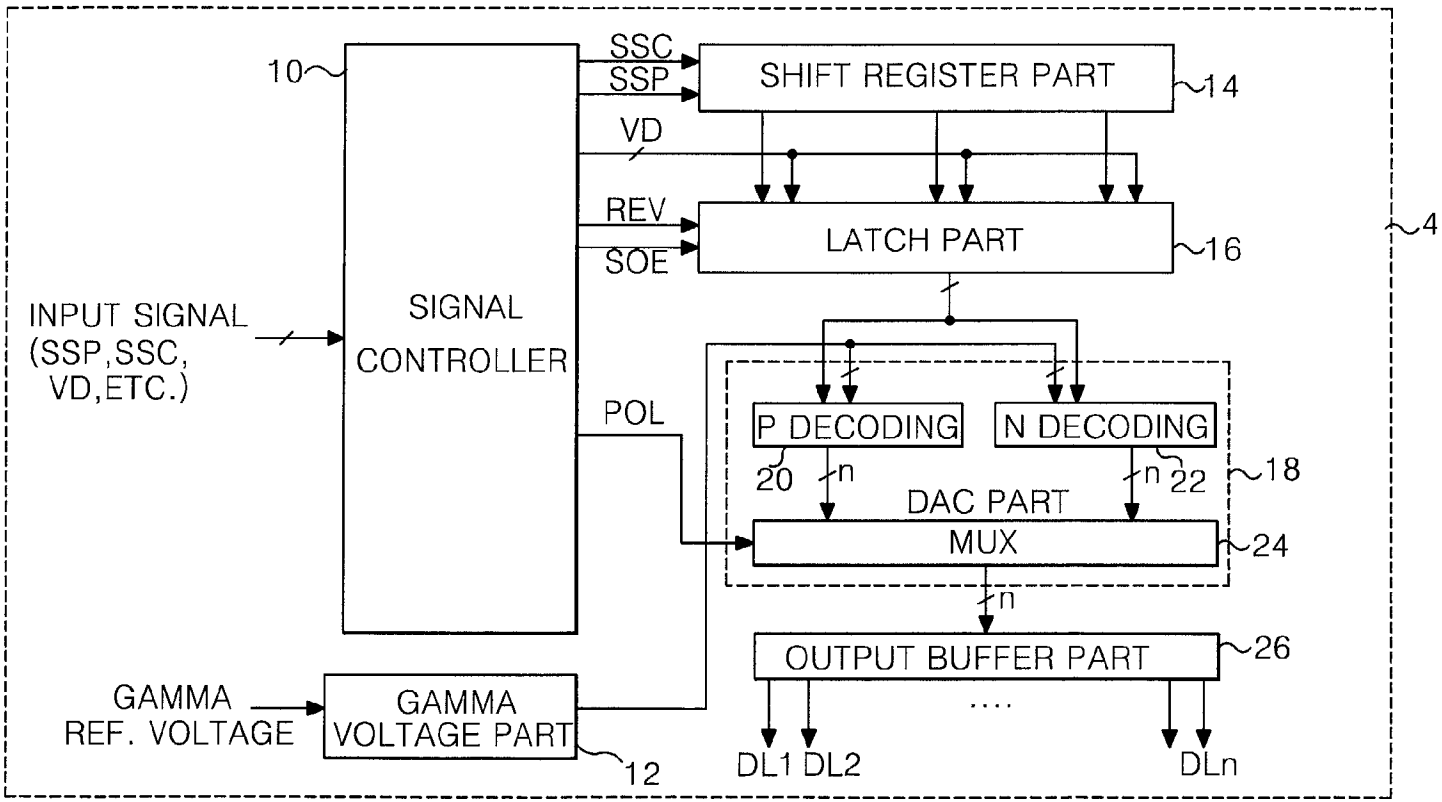
FIG.2 CONVENTIONAL ART
FIG. 2 is a detailed block diagram showing a configuration of the data driving integrated circuit in FIG. 1.
Figure 4A:
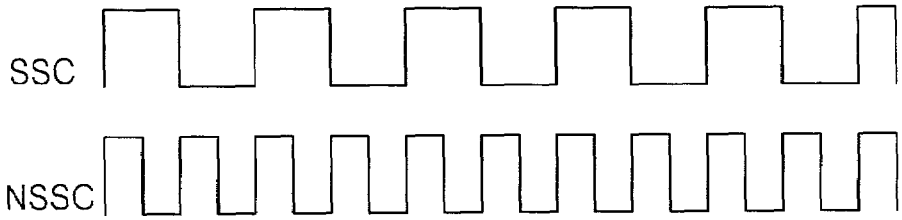
FIGS. 4A and 4B are comparative waveform diagrams of driving signals of the latch part shown in FIG. 2 and the latch part shown in FIG. 3.
Figure 4B:
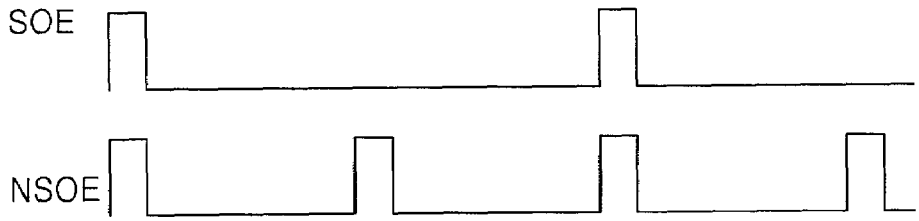

Herein, the source sampling clock signal SSC and the source output enable signal SOE applied to the shift register part 36 and the latch part 38 have twice the frequency of the "SSC" and "SOE" applied to the conventional shift register part 14 and latch part 16 shown in FIG. 2, as indicated by "NSSC" and "NSOE" in FIGS. 4A and 4B, respectively.

The DAC 40 converts n pixel data from the latch part 38 into positive and negative pixel signals at the same time, and divides the pixel signals k by k in response to a polarity control signal POL and a first selection control signal SEL1 and outputs the signals. To this end, the DAC 40 includes a positive (P) decoding part 42 and a negative (N) decoding part 44, each of which are commonly connected to the latch part 38, and a multiplexor (MUX) 46 for selecting output signals of the P and N decoding parts 42 and 44.

A plurality of n P decoders, which are included in the P decoding part 42, convert n pixel data simultaneously inputted from the latch part 38 into positive pixel signals with the aid of positive gamma voltages from the gamma voltage part 34. A plurality of n N decoders, which are included in the N decoding part 44, convert n pixel data simultaneously inputted from the latch part 38 into negative pixel signals with the aid of negative gamma voltages from the gamma voltage part 34. The multiplexor 46 responds to the polarity control signal POL from the signal controller 32 to selectively output the positive pixel signals from the P decoding part 42 or the negative pixel signals from the N decoding part 44, and responds to the first selection control signal SEL1 to divide the n pixel signals k by k and output the signals. In this case, the bit number of the first selection control signal SEL1 is defined depending on the divided frequency j of the n pixel signals. For instance, if the n pixel signals are outputted while being divided 8 by 8 (j=8), then the first selection control signal SEL1 may be constructed by 3 bits. As mentioned above, in order to process the 2n pixel data, the DAC 40 converts each n pixel data into pixel signals at a speed twice that of the conventional DAC 18, and divides the n pixel signals k by k (wherein k<n) and outputs the signals.

The first demultiplexor 48 outputs each of the k pixel signals from the multiplexor 46 to the first output buffer IC 50 or the second output buffer IC 50 in response to a second selection control signal SEL2 inputted from the signal controller 32. In this case, since the second selection control signal SEL2 also is defined depending on the divided frequency j of the n pixel signals, it has the same bit number as the first selection control signal SEL1.

Each of the first and second output buffer ICs 50 samples and holds the pixel signals inputted k by k from the DAC IC 30 to simultaneously output them to the n data lines DL11 to DL1*k*, . . . , DLj1 to DLjk. To this end, each of the first and second output buffer ICs 50 consists of a second demultiplexor 52 and 1st to jth output buffer parts 54.

The second demultiplexor 52 sequentially applies the pixel signals inputted k by k from the first demultiplexor 48 to the 1st to jth output buffer parts 54 in response to a third selection control signal SEL3 from a timing controller (not shown). In this case, the third selection control signal SEL3 also has the bit number corresponding to the divided frequency j of the n pixel signals like the first and second selection control signals SEL1 and SEL2.

Figure 5:
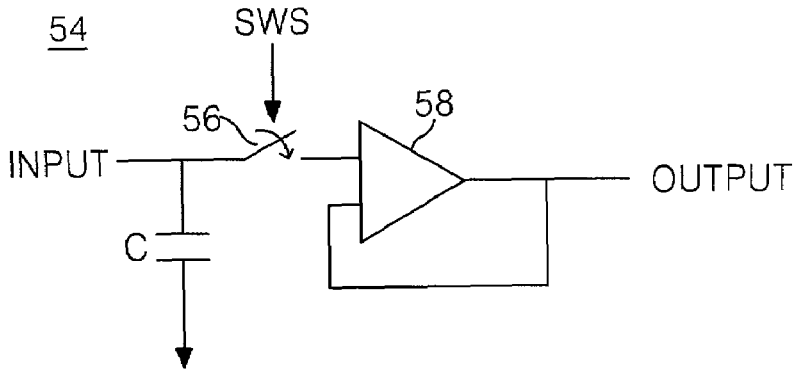
FIG. 5 is a circuit diagram showing a configuration of each output buffer included in the output buffer part shown in FIG. 3.

The 1st to jth output buffer parts 54 sequentially receive each of the k pixel signals from the second demultiplexor 52 and holds the signal. Then, the 1st to jth output buffer parts 54 simultaneously apply each of the held k pixel signals to the corresponding data lines DL11 to DL1*k*, . . . , DLj1 to DLjn in response to a switch control signal SWS from the timing controller. Each of the 1st to jth output buffer parts 54 consists of k output buffers, which are connected to the corresponding data lines DL11 to DL1*k*, . . . , DLj1 to DLjn at a relationship of 1 to 1. As shown in FIG. 5, each of the k output buffers includes a capacitor C for charging and holding an input pixel signal INPUT, a switching device 56 for allowing the pixel signal hold at the capacitor C to be outputted in response to a switch control signal SWS from the timing controller, and a voltage follower 58 connected to the switching device 56 to buffer the pixel signal, thereby outputting it as an output pixel signal OUTPUT.

Figure 6:
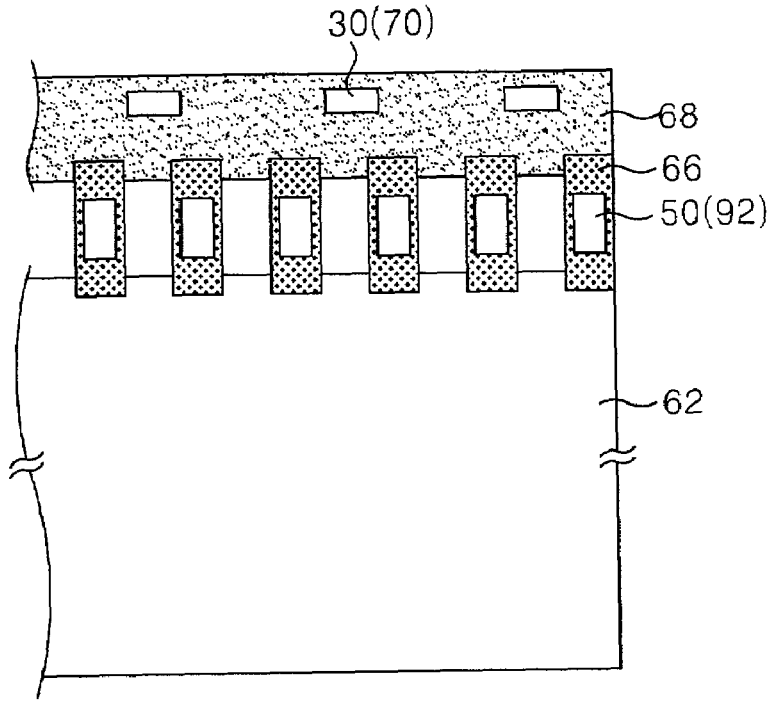
FIG. 6 is a schematic view of the data driving block of the liquid crystal display including a data driver shown in FIG. 3.

As shown in FIG. 6, the DAC ICs 30 are mounted in a data PCB 68 while the output buffer ICs 50 are mounted in a TCP 66, separately. The data PCB 68 plays sends various control signals from a timing controller (not shown) and data signals to the DAC ICs 30 and sends pixel signals from the DAC ICs 30 to the output buffer ICs 50 via the TCP 66. The TCP 66 is electrically connected to data pads provided at the upper portion of a liquid crystal display panel 62 and output pads provided at the PCB 68.

As described above, the simply configured output buffer ICs 50, having only a buffering function, is mounted in the TCP 66, so that only the output buffer ICs 50 are damaged when the TCP 66 is damaged. As a result, the large loss in costs resulting from an inability to use the expensive data driving ICs caused by the damaged TCP 66 in the prior art can be reduced dramatically. Furthermore, the DAC IC 30 is driven on a time division basis to sequentially apply the pixel signals to at least two output buffer ICs 50. Accordingly, the number of DAC ICs 30 is reduced to at least ½ in comparison to prior art arrangements, so that it becomes possible to reduce the manufacturing cost.

Particularly, as the DAC 40 of the DAC IC 30 time-divides n pixel signals into j signals to be applied k by k, the number of input pins of each output buffer IC 50 can be reduced to k<n, which is the number of output pins connected to the n data lines DL11 t DL1*k*, . . . , DLj1 to DLjn. Thus, the number of input pins of the TCP 66 mounted with the output buffer ICs 50 also is reduced, so that it becomes easy to assure a pitch of an output pad of the data PCB 68 connected to the input pins of the TCP 66. In other words, as the present data driving apparatus sends the pixel signals from the DAC IC 30, via the data PCB 68 and the TCP 66, to the output buffer ICs 50, the data PCB 68 requires a relatively larger number of signal transmission lines and output pads as compared to the conventional data PCB transmitting digital pixel data. As a result, although it was difficult to assure a pitch of an output pad on the data PCB 68 in prior art arrangements, the present data driving apparatus drives the pixel signals on a time division basis to reduce the output pad, thereby providing an easy assurance of the output pad pitch.

Figure 7:
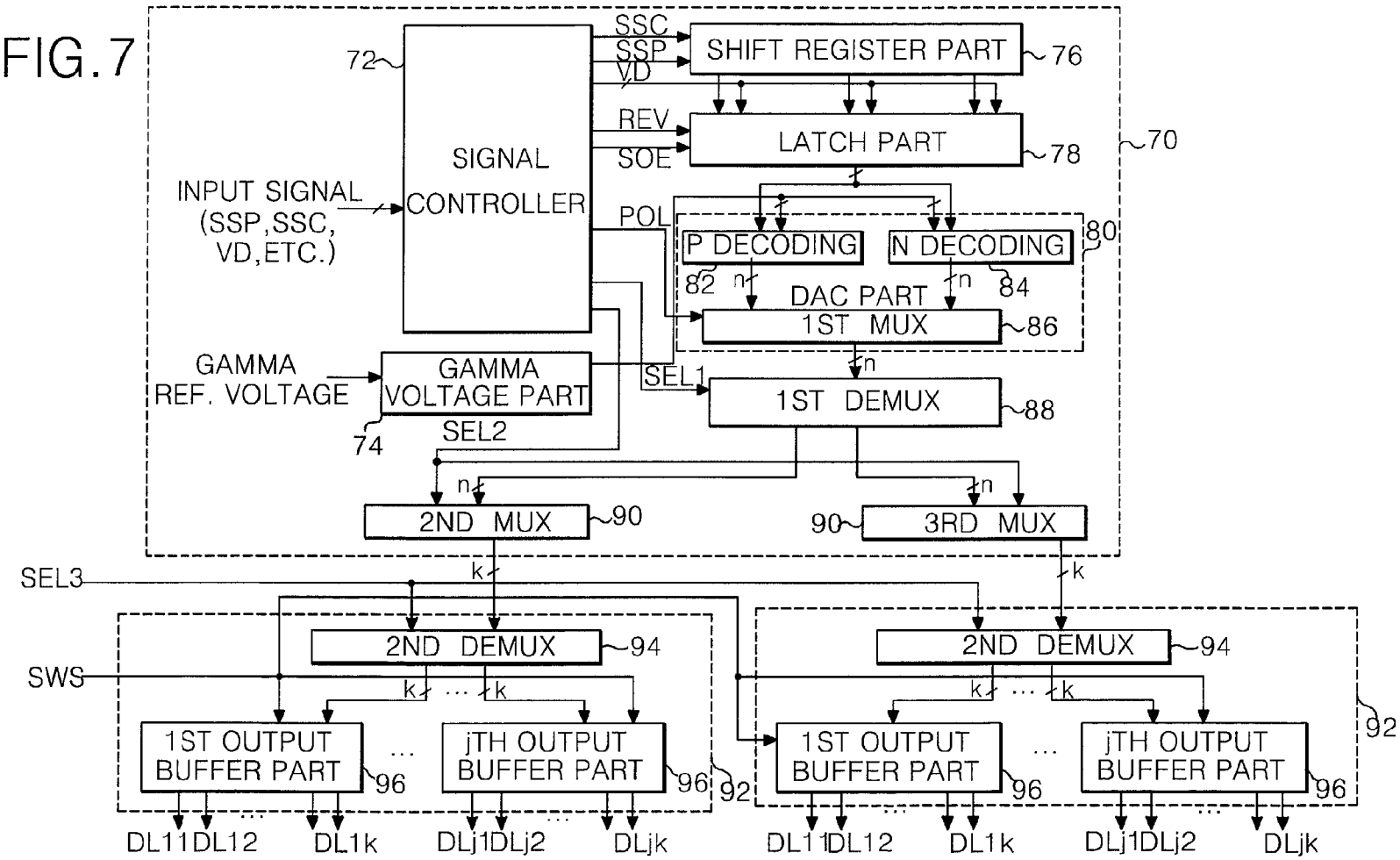
FIG. 7 is a block diagram showing a configuration of a data driver in a liquid crystal display according to another embodiment of the present invention.

FIG. 7 is a block diagram showing a configuration of a data driving apparatus for a liquid crystal display according to another embodiment of the present invention.

The data driving apparatus shown in FIG. 7 has the same elements as that shown in FIG. 3 except that it further includes second and third multiplexors 90 for providing a division function of the n pixel signals of the multiplexor 46 in FIG. 3. Herein, at least two output buffer ICs 92 are commonly connected to a single DAC IC 70.

Referring to FIG. 7, 2n pixel data to be supplied to 2n data lines DL11 to DL1n and DL21 to DL2n are divided on a time basis n by n to be inputted to the DAC IC 70. The DAC IC 70 converts n input pixel data into analog pixel signals. Further, the DAC IC 70 again divides the n pixel signals converted into analog signals k by k (wherein k<n) to selectively apply them to the first and second output buffer ICs 92. Since the DAC IC 70 should divide the 2n pixel data n by n to provide a digital to analog conversion function, doing so requires driving signals having frequencies twice those of the conventional driving signals.

To this end, the DAC IC 70 includes a shift register part 76 for applying a sequential sampling signal. A latch part 78 sequentially latches a pixel data VD in response to the sampling signal and outputs the pixel data VD at the same time. A digital to analog converter (DAC) 80 converts the pixel data VD from the latch part 78 into a pixel signal. A first demultiplexor (DEMUX) 88 sequentially applies the pixel signal from the DAC 80 to the second and third multiplexors 90. The second and third multiplexors 90 divide the pixel signals from the first demultiplexor 88 on a time basis to apply the signals to the first and second output buffer ICs 92. Further, the DAC IC 70 includes a signal controller 72 for interfacing various control signals from a timing controller (not shown) and the pixel data VD. A gamma voltage part 74 supplies positive and negative gamma voltages required in the DAC 40.

The signal controller 72 controls various control signals such as, for example, SSP, SSC, SOE, REV and POL from the timing controller and the pixel data VD to output them to the corresponding elements. In this case, the timing controller allows the various control signals and the pixel data VD to have a frequency twice that of prior art arrangements. Particularly, the timing controller makes a time division of 2n pixel data VD corresponding to the 2n data lines DL11 to DLln and DL21 to DL2n into two regions to sequentially supply them n by n.

The gamma voltage part 74 sub-divides a plurality of gamma reference voltages from a gamma reference voltage generator (not shown) for each gray level and outputs them.

Shift registers included in the shift register part 76 sequentially shift a source start pulse SSP from the signal controller 72 in response to a source sampling clock signal SSC to output the source start pulse SSP as a sampling signal. In this case, the shift register part 76 responds to the source start pulse SSP and the source sampling clock signal SSC each having a frequency doubled to output a sampling signal at twice the speed in comparison to prior art arrangements.

A plurality of n latches included in the latch part 78 sequentially sample the pixel data VD from the signal controller 72 in response to the sampling signal from the shift register part 76 to latch it. Subsequently, the n latches respond to a source output enable signal SOE from the signal controller 72 to output the latched pixel data VD at the same time. In this case, the latches restore the pixel data VD modulated in such a manner as to have a reduced transition bit number in response to a data inversion selecting signal REV and then output the pixel data VD. This is because the pixel data VD, having a transition bit number going beyond a reference value, is supplied such that it is modulated to have a reduced transition bit number in order to minimize an electromagnetic interference (EMI) upon data transmission from the timing controller.

Herein, the source sampling clock signal SSC and the source output enable signal SOE applied to the shift register part 76 and the latch part 78 have twice the frequency of the "SSC" and "SOE" applied to the conventional shift register part 14 and latch part 16 shown in FIG. 2, as indicated by "NSSC" and "NSOE" in FIGS. 4A and 4B, respectively.

The DAC 80 converts n pixel data from the latch part 78 into positive and negative pixel signals at the same time and outputs the signals. To this end, the DAC 80 includes a positive (P) decoding part 82 and a negative (N) decoding part 84, each of which are commonly connected to the latch part 78, and a first multiplexor (MUX) 86 for selecting output signals of the P and N decoding parts 82 and 84.

A plurality of n P decoders, which are included in the P decoding part 82, convert n pixel data simultaneously inputted from the latch part 78 into positive pixel signals with the aid of positive gamma voltages from the gamma voltage part 74. A plurality of n N decoders, which are included in the N decoding part 84, convert n pixel data simultaneously inputted from the latch part 78 into negative pixel signals with the aid of negative gamma voltages from the gamma voltage part 74. The first multiplexor 86 responds to the polarity control signal POL from the signal controller 72 to select the positive pixel signals from the P decoding part 82 or the negative pixel signals from the N decoding part 84, thereby outputting them n by n. As mentioned above, in order to process the 2n pixel data, the DAC 80 converts each n pixel data into pixel signals at a speed twice that of the conventional DAC 18.

Figure 8:
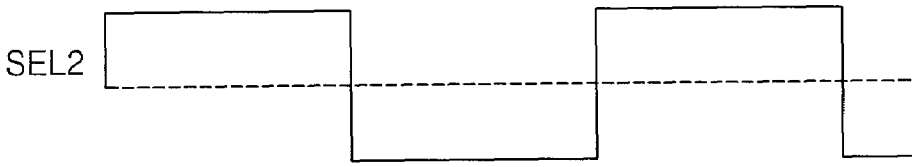
FIG. 8 is a waveform diagram of a driving signal for the first demultiplexor shown in FIG. 7.

The first demultiplexor 88 selectively outputs n pixel signals from the first multiplexor 86 to the second and third multiplexors 90 in response to a first selection control signal SEL1 inputted from the signal controller 72 as shown in FIG. 8. The first selection control signal SEL1 inverts a logical value every period of a source output enable signal SOE applied to the latch part 78, thereby allowing each of the n pixel signals to be selectively outputted to the two second multiplexors 90.

Each of the second and third multiplexors 90 divides the pixel signals applied n by n from the first demultiplexor 88 k by k in response to a second selection control signal SEL2 from the signal controller 72 to output the pixel signals. In this case, the bit number of the second selection control signal SEL2 is defined based on the divided frequency j of the n pixel signals. For instance, if the n pixel signals are outputted while being divided by 8 (j=8), then the second selection control signal SEL2 may be constructed by 3 bits.

Each of the first and second output buffer ICs 92 samples and holds the pixel signals inputted k by k from the DAC ICs 70 to simultaneously output the pixel signals to the n data lines DL11 to DL1*k*, . . . , DLj1 to DLjk. To this end, each of the first and second output buffer ICs 92 consists of a second demultiplexor 94 and 1st to jth output buffer parts 96.

The second demultiplexor 94 sequentially applies the pixel signals inputted k by k from each of the second and third multiplexors 90 to the 1st to jth output buffer parts 96 in response to a third selection control signal SEL3 from a timing controller (not shown). In this case, the third selection control signal SEL3 also has the bit number corresponding to the divided frequency j of the n pixels signals like the first and second selection control signals SEL1 and SEL2.

The 1st to jth output buffer parts 96 sequentially receive each of the k pixel signals from the second demultiplexor 94 and hold the pixel signals. Then, the 1st to jth output buffer parts 96 simultaneously apply each of the held k pixel signals to the corresponding data lines DL11 to DL1*k*, . . . , DLj1 to DLjn in response to a switch control signal SWS from the timing controller. Each of the 1st to jth output buffer parts 96 consists of k output buffers, which are connected to the corresponding data lines DL11 to DL1*k*, . . . , DLj1 to DLjn at a 1 to 1 relationship. As shown in FIG. 5, each of the k output buffers includes a capacitor C for charging and holding an input pixel signal INPUT. A switching device 56 allows the pixel signal held at the capacitor C to be outputted in response to a switch control signal SWS from the timing controller. A voltage follower 58 is connected to the switching device 56 to buffer the pixel signal, thereby outputting it as an output pixel signal OUTPUT.

As shown in FIG. 6, the DAC ICs 70 are mounted in a data PCB 68 while the output buffer ICs 92 are separately mounted in a TCP 66. The data PCB 68 sends various control signals from a timing controller (not shown) and data signals to the DAC ICs 70 and sends pixel signals from the DAC ICs 70 to the output buffer ICs 92 via the TCP 66. The TCP 66 is electrically connected to data pads provided at the upper portion of a liquid crystal display panel 62 and output pads provided at the PCB 68.

As described above, the simply configured output buffer ICs 92, having only a buffering function, is mounted in the TCP 66, so that only the output buffer ICs 92 only are damaged when the TCP 66 is damaged. As a result, the large loss in costs resulting from an inability to use the expensive data driving ICs caused by a damaged TCP 66 in the prior art can be reduced dramatically. Furthermore, the DAC ICs 70 are driven on a time division basis to sequentially apply the pixel signals to at least two output buffer ICs 50. Accordingly, the number of DAC ICs 70 is reduced to at least ½ in comparison to prior art arrangements, so that it becomes possible to lower the manufacturing cost.

Particularly, as the DAC ICs 70 time-divide n pixel signals into j signals to be applied k by k, the number of input pins of each output buffer IC 92 can be reduced to k<n, which is the number of output pins connected to the n data lines DL11 t DL1*k*, . . . , DLj1 to DLjn. Thus, the number of input pins of the TCP 66 mounted with the output buffer ICs 92 also is reduced, so that it becomes easy to assure a pitch of an output pad of the data PCB 68 connected to the input pins of the TCP 66. In other words, as the present data driving apparatus sends the pixel signals from the DAC ICs 70, via the data PCB 68 and the TCP 66, to the output buffer ICs 92, the data PCB 68 requires a relatively larger number of signal transmission lines and output pads than the conventional data PCB transmitting digital pixel data. As a result, although it was difficult to assure a pitch of an output pad on the data PCB 68 in prior art arrangements, the present data driving apparatus drives the pixel signals on a time division basis to reduce the output pad, thereby providing an easy assurance of the output pad pitch.

As described above, according to the present invention, the DAC means and the output buffering means are integrated into separate chips to thereby mount only the simply configured output buffer ICs in the TCP having a high probability of breaking or short-circuiting. Accordingly, it is possible to dramatically reduce loss resulting from the inability to use the expensive data driver ICs due to a damaged TCP in prior art arrangements.

Furthermore, according to the present invention, the DAC ICs are driven on a time division basis with the aid of driving signals having higher frequencies to thereby commonly connect a single DAC IC to at least two output buffer ICs, so that it becomes possible to reduce the number of DAC ICs and thus the manufacturing cost.

Moreover, according to the present invention, the DAC ICs time-divide the pixel signals converted into analog signals to apply the pixel signals thereby reducing the number of input pins of each output buffer IC. Accordingly, the number of input pins of the TCP mounted with the output buffer ICs is reduced, so that it becomes easy to assure a pitch of the output pad of the data PCB connected to the input pins of the TCP.

It will be apparent to those skilled in the art that various modifications and variations can be made in the data driving apparatus and method of liquid crystal display of the present invention without departing from the spirit or scope of the inventions. Thus, it is intended that the present invention covers the modifications and variations of this invention provided they come within the scope of the appended claims and their equivalents.

What is claimed is:

1. A data driving apparatus for a liquid crystal display, comprising:

at least one digital to analog converter circuit for converting input pixel data into a plurality of pixel signals, time-dividing the converted pixel signals, and demultiplexing the time-divided pixel signals to output the demultiplexed time-divided pixel signals, wherein the number of the converted pixel signals is greater than that of the time-divided pixel signals;

at least two output buffer circuits for selectively receiving the demultiplexed time divided pixel signals from the digital to analog converter circuit, the selected output buffer circuit sequentially receiving and holding the demultiplexed time-divided pixel signals, and then buffering and outputting the held pixel signals to a plurality of data lines, at least two of the plurality of output buffer circuits being commonly connected to one digital to analog converter circuit; and a timing controller for controlling the digital to analog converter circuit and the output buffer circuits, time-dividing the input pixel data into at least two regions, and sequentially supplying the time-divided pixel data to the digital to analog converter circuit.

2. The data driving apparatus according to claim 1, wherein the digital to analog converter circuit is mounted on a printed circuit board connected to the timing controller, and the output buffer circuits are mounted on a tape carrier package electrically connected between the printed circuit board and a liquid crystal display panel at which the data lines are arranged.

3. The data driving apparatus according to claim 1, wherein the digital to analog converter circuit includes:

a shift register for sequentially outputting a sampling signal under control of the timing controller;

a latch for responding to the control of the timing controller and the sampling signal to sequentially latch pixel data inputted from the timing controller and to output the latched pixel data at the same time;

a digital to analog converter part for converting the pixel data into positive and negative pixel signals using input gamma voltages to output the pixel signals in response to a polarity control signal from the timing controller and for time-dividing the pixel signals in response to a first selection control signal from the timing controller to output the pixel signals; and a demultiplexor for responding to a second selection control signal from the timing controller to selectively output the pixel signals from the digital to analog converter part to the at least two output buffer circuits.

4. The data driving apparatus according to claim 1, wherein the digital to analog converter circuit includes:

a signal controller for interfacing control signals from the timing controller and the pixel data to apply the control signals to the shift register, the latch, the digital to analog converter part, and the demultiplexor; and a gamma voltage generator for sub-dividing an input gamma reference voltage to generate gamma voltages.

5. The data driving apparatus according to claim 3, wherein the digital to analog converter part includes:

a positive decoder for converting the pixel data into positive pixel signals using gamma voltages;

a negative decoder for converting the pixel data into negative pixel signals using gamma voltages; and a multiplexor commonly connected to the positive and negative decoders to sequentially output each of the pixel signals in response to the polarity control signal and the first selection control signal to the demultiplexor.

6. The data driving apparatus according to claim 3, wherein the first and second selection control signals have the bit number corresponding to a number of the time-divided pixel signals.

7. The data driving apparatus according to claim 1, wherein the digital to analog converter circuit includes:

a shift register for sequentially outputting the sampling signal under control of the timing controller;

a latch for responding to the control of the timing controller and the sampling signal to sequentially latch pixel data inputted from the timing controller and to output the latched pixel data at the same time;

a digital to analog converter part for converting the pixel data into positive and negative pixel signals using input gamma voltages to selectively output the pixel signals in response to a polarity control signal from the timing controller;

a demultiplexor for responding to a first selection control signal from the timing controller to selectively output the pixel signals to at least two output terminals; and at least two multiplexors, being connected to the at least two output terminals, for responding to a second selection control signal from the timing controller to time-divide and output the pixel signals.

8. The data driving apparatus according to claim 7, wherein the digital to analog converter circuit includes:

a signal controller for interfacing control signals from the timing controller and the pixel data to apply the control signals to the shift register, the latch, the digital to analog converter part, and the demultiplexor; and a gamma voltage generator for sub-dividing an input gamma reference voltage to generate gamma voltages.

9. The data driving apparatus according to claim 3, wherein the first selection control signal has a logical state converted every period of an output enable signal controlling an output of the latch, and the second selection control signal has a bit number corresponding to a number of the time-divided pixel signals.

10. The data driving apparatus according to claim 1, wherein each of the output buffer circuits includes:

a plurality of output buffer parts connected to the plurality of data lines to provide holding and buffering functions of the pixel signals; and a demultiplexor for responding to a selection control signal from the timing controller to sequentially apply the pixel signals outputted from the digital to analog converter circuit to the output buffer parts.

11. The data driving apparatus according to claim 10, wherein each of the output buffer parts consists of a plurality of output buffers each connected to corresponding ones of the plurality of data lines, each output buffers including:

a holder for receiving and holding the pixel signals;

a switch for responding to the control signal from the timing controller to output the held pixel signals; and a voltage follower connected to the switching means to provide a signal buffering function.

12. The data driving apparatus according to claim 10, wherein the selection control signal has a bit number corresponding to a number of the time-divided pixel signals.

13. The data driving apparatus according to claim 1, wherein a frequency of the control signals are increased in relation to the number of time-divisions of the pixel data.

14. The data driving apparatus according to claim 2, wherein a tape carrier package mounted with the plurality of output buffer circuits has a plurality of input pins and a plurality of output pins.

15. A method of driving a data driving apparatus for driving a plurality of data lines arranged at a liquid crystal display panel wherein the driving apparatus includes a plurality of output buffer circuits connected to the plurality of data lines, and at least one digital to analog converter circuit commonly connected to input terminals of at least two of the plurality of output buffer circuits, the method comprising:

time-dividing pixel data to be supplied to the digital to analog converter circuit into at least two regions to provide a first time division of the pixel data;

allowing the digital to analog converter circuit to convert each pixel data into analog pixel signals and time-dividing the converted pixel signals to provide a second time division of the converted pixel signals;

demultiplexing the time-divided pixel signals;

outputting the demultiplexed time-divided pixel signals to a selected one of the at least two output buffer circuits;

allowing the selected output buffer circuit to sequentially receive and hold each of the demultiplexed time-divided pixel signals and buffer the pixel signals; and applying the buffered pixel signals to the data lines from the at least two output buffer circuits.

16. The method according to claim 15, wherein allowing the digital to analog converter circuit to convert the pixel data into the pixel signals includes:

converting the pixel data into positive and negative pixel signals using gamma voltages and sequentially applying each of the pixel signals responding to a polarity control signal and a first selection control signal from the exterior; and responding to a second selection control signal from the exterior to selectively apply each of the pixel signals to the at least two output buffer circuits.

17. The method according to claim 15, wherein allowing the digital to analog converter circuit to convert the pixel data into the pixel signals includes:

converting the pixel data into positive and negative pixel signals using gamma voltages and sequentially applying the pixel signals responding to a polarity control signal from the exterior; and time-dividing the converted pixel signals in response to a selection control signal from the exterior to supply the pixel signals.

18. The method according to claim 15, wherein a sampling speed of the pixel data and a conversion speed of the pixel data into the pixel signals are increased in relation to the number of time-divisions of the pixel data.

19. The driving apparatus according to claim 1, wherein the input pixel data are time-divided based on a first time division and are converted to provide the converted pixel signals, and the converted pixel signals are time-divided based on a second time division to provide the time-divided pixel signals.

20. The driving apparatus according to claim 19, wherein the first time division is based on n-by-n, n being a positive integer greater than one, the second time division is based on k-by-k, k being a positive integer greater than one and less than n, the time-divided pixel signals are outputted to one of the at least two output buffer circuits k-by-k, and the buffered pixel signals are outputted to the data lines from the at least two output buffer circuits n-by-n.

21. The driving apparatus according to claim 1, wherein the digital to analog converter circuit further includes at least two output terminals to which the demultiplexed time-divided pixel signals are output.

22. A data driving apparatus for a liquid crystal display, comprising:

at least one digital to analog converter circuit for converting input pixel data into a plurality of pixel signals and time-dividing the converted pixel signals to output the time-divided pixel signals, wherein the number of the converted pixel signals is greater than that of the time-divided pixel signals, the at least one digital to analog converter circuit including, a shift register for sequentially outputting the sampling signal under control of the timing controller, a latch for responding to the control of the timing controller and the sampling signal to sequentially latch pixel data inputted from the timing controller and to output the latched pixel data at the same time, a digital to analog converter part for converting the pixel data into positive and negative pixel signals using input gamma voltages to selectively output the pixel signals in response to a polarity control signal from the timing controller, a demultiplexor for responding to a first selection control signal from the timing controller to selectively output the pixel signals to at least two output terminals, and at least two multiplexors, being connected to the at least two output terminals, for responding to a second selection control signal from the timing controller to time-divide and output the pixel signals;

at least two output buffer circuits for selectively receiving the time divided pixel signals from the digital to analog converter circuit, the selected output buffer circuit sequentially receiving and holding the time-divided pixel signals, and then buffering and outputting the held pixel signals to a plurality of data lines, at least two of the plurality of output buffer circuits being commonly connected to one digital to analog converter circuit; and a timing controller for controlling the digital to analog converter circuit and the output buffer circuits, time-dividing the input pixel data into at least two regions, and sequentially supplying the time-divided pixel data to the digital to analog converter circuit.

23. The data driving apparatus according to claim 22, wherein the digital to analog converter circuit further includes:

a signal controller for interfacing control signals from the timing controller and the pixel data to apply the control signals to the shift register, the latch, the digital to analog converter part, and the demultiplexor; and a gamma voltage generator for sub-dividing an input gamma reference voltage to generate gamma voltages.

* * * * *